US006293444B1

(12) United States Patent
Miller

(10) Patent No.: US 6,293,444 B1
(45) Date of Patent: Sep. 25, 2001

(54) CLAMP FOR HOLDING IN ONE HAND AND ASSISTING IN DONNING A BRACELET

(76) Inventor: Caroline Miller, 6543 Parsons Blvd., Flushing, NY (US) 11365

( * ) Notice: Subject to any disclaimer, the term of this patent is extended or adjusted under 35 U.S.C. 154(b) by 0 days.

(21) Appl. No.: 09/450,038

(22) Filed: Nov. 29, 1999

(51) Int. Cl.[7] ..... A47G 25/80
(52) U.S. Cl. ..... 223/111; 24/499
(58) Field of Search ..... 223/111, DIG. 2; 24/499, 500, 520

(56) References Cited

U.S. PATENT DOCUMENTS 928,086 * 7/1909 Viganego ..... 223/96
5,142,776 * 9/1992 Neely ..... 24/510
5,709,327 * 1/1998 LaMacchia et al. ..... 223/111
5,934,526 * 8/1999 Rosenbaum et al. ..... 223/111
6,036,065 * 3/2000 Wofford et al. ..... 223/111

* cited by examiner

*Primary Examiner*—Bibhu Mohanty

(57) ABSTRACT

A clamp for holding in one hand and assisting in donning a bracelet. The clamp includes a stationary jaw and a movable jaw. The stationary jaw extends along the palm of the one hand on which the bracelet is to be donned and the wrist on which the bracelet is to be donned and is releasably grasped between the palm of the one hand on which the bracelet is to be donned and the fingers of the one hand on which the bracelet is to be donned. The movable jaw is pivotally mounted to, and biased against, the stationary jaw, and together with the stationary jaw releasably hold one end of the bracelet therebetween.

17 Claims, 1 Drawing Sheet

CLAMP FOR HOLDING IN ONE HAND AND ASSISTING IN DONNING A BRACELET

BACKGROUND OF THE INVENTION

1. Field of the Invention

The present invention relates to a clamp. More particularly, the present invention relates to a clamp for holding in one hand and assisting in donning a bracelet.

2. Description of the Prior Art

Jewelry, such as rings, broaches, necklaces, and bracelets, is widely used by women and men for ornamentation. Particularly, bracelets are ornamental bands or chains, or string of beads or pearls worn around a person's wrist. Although some bracelets are formed various materials into a shape of a continuous band that is slid over a person's hand, most bracelets have a releasable clasp for connecting together the two ends of the bracelet to securely retain the bracelet around a person's wrist.

A typical clasp has a first interlocking member and a second releasably operable, usual spring biased, interlocking member, each of which is attached to opposite ends of a bracelet.

An example of a typical clasp, for connecting the ends of a bracelet and securing the bracelet around a person's wrist, generally consists of a small continuous ringlet or loop at one end of the bracelet and a releasably operable hook or loop attached at the other end of the bracelet. The releasably operable hook interlocks with the ringlet to connect the two ends of the bracelet together.

Another example, of a typical clasp, for use in connecting the ends of a bracelet and securing the bracelet around a person's wrist, generally includes a receiving member having a cavity attached at one end of the bracelet and a mating member having an insertable projection attached at the other end of the bracelet. Either of the receiving or the mating members can be releasably operable. The mating member interlocks with the receiving member to connect the two ends of the bracelet together.

Various other configurations of releasable clamps have been devised for connecting the ends of a bracelet together and retain it around a person's wrist.

A major problem with a bracelet having a releasable clasp is in the effort required by a person to easily and quickly fasten the around his or her wrist. Manually fastening a bracelet around one's wrist requires an individual to exhibit great dexterity. First, the hand, adjoining the wrist upon which the bracelet is to be worn, if often of no help in manipulating the clasp. Often, a person must solely use one hand, the hand opposite from the wrist to which the bracelet is to be worn, to hold the first interlocking member in place on their wrist while attempting to connect the second usually releasably operable interlocking member. Frequently, a person needs to try several times in order to successfully connect the clasp of the bracelet when trying to fasten it around his or her wrist.

Numerous innovations for bracelet fastening devices have been provided in the prior art that will be described. Even though these innovations may be suitable for the specific individual purposes to which they address, however, they differ from the present invention.

FOR EXAMPLE, U.S. Pat. No. Des. 323,132 to Grennan teaches the ornamental design for a bracelet fastening tool.

ANOTHER EXAMPLE, U.S. Pat. No. Des. 348,187 to Higgins teaches the ornamental design for a bracelet attaching tool.

STILL ANOTHER EXAMPLE, U.S. Pat. No. Des. 387,253 to Fakler teaches the ornamental design for a bracelet fastener helper.

YET ANOTHER EXAMPLE, U.S. Pat. No. 5,405,066 to Fakler teaches a bracelet clasp fastening aid that has a curved portion for gripping the edge of a table or counter top and another curved portion for receiving one's wrist. Pressure is applied from the wrist onto the curved side allowing the other hand to be free to attach both sides of a bracelet clasp.

FINALLY, STILL YET ANOTHER EXAMPLE, U.S. Pat. No. 5,709,327 to LaMacchia et al. teaches a bracelet fastening device to assist a person in quickly and easily fastening a bracelet around his or her wrist. The device overcomes the problems associated with fastening a bracelet around one's own wrist without the assistance of another person and particularly by a person with impaired fine motor skills. The device generally includes a handle and releasable clamping means operably attached to the handle. The clamping means is operable to releasably hold at least one interlocking member of a releasable clasp of a bracelet. The handle is sized and configured to be held in a hand of a person, so that the clamping means is positioned to rest on a wrist adjoining the hand holding the handle. A person using the bracelet fastening device can hold and position with one hand at least one interlocking member of the releasable clasp on the adjoining wrist while using the other free hand to fasten the other interlocking member of the clasp therewith to securely retain the bracelet around the wrist.

It is apparent that numerous innovations for bracelet fastening devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a clamp for holding in one hand and assisting in donning a bracelet that avoids the disadvantages of the prior art.

ANOTHER OBJECT of the present invention is to provide a clamp for holding in one hand and assisting in donning a bracelet that is simple and inexpensive to manufacture.

STILL ANOTHER OBJECT of the present invention is to provide a clamp for holding in one hand and assisting in donning a bracelet that is simple to use.

BRIEFLY STATED, YET ANOTHER OBJECT of the present invention is to provide a clamp for holding in one hand and assisting in donning a bracelet. The clamp includes a stationary jaw and a movable jaw. The stationary jaw extends along the palm of the one hand on which the bracelet is to be donned and the wrist on which the bracelet is to be donned and is releasably grasped between the palm of the one hand on which the bracelet is to be donned and the fingers of the one hand on which the bracelet is to be donned. The movable jaw is pivotally mounted to, and biased against, the stationary jaw, and together with the stationary jaw releasably hold one end of the bracelet therebetween.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
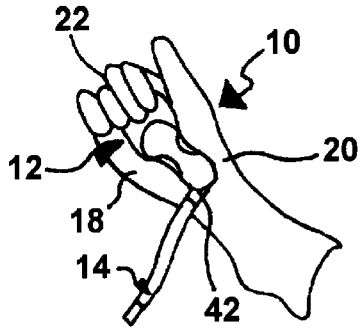
FIG. 1 is a diagrammatic perspective view of the present invention in use.

10 clamp for holding in one hand and assisting in donning a bracelet of the present invention
12 one hand
14 bracelet
16 stationary jaw for extending along palm of one hand 12 and for being releasably grasped between palm 18 of one hand 12 and fingers 22 of one hand 12
18 palm of one hand 12
20 wrist of one hand 12
22 fingers of one hand 12
24 proximal end of stationary jaw 16 for being releasably grasped between palm 18 of one hand 12 and fingers 22 of one hand 12
26 distal end of stationary jaw 16 for resting on wrist 20 of one hand 12
28 coplanar flare of distal end 26 of stationary jaw 16
30 pair of longitudinal edges of distal end 26 of stationary jaw 16
32 pair of tabs of stationary jaw 16
34 pair of aligned throughbores extending, respectively, through pair of tabs 32 of stationary jaw 16
36 first surface of stationary jaw 16 for facing palm 18 of one hand 12
38 second surface of stationary jaw 16 for contacting fingers 22 of one hand 12
40 movable jaw
42 one end of bracelet 14
44 proximal end of movable jaw 40
46 coplanar flare of proximal end 44 of movable jaw 40
48 distal end of movable jaw 40
50 coplanar flare of distal end 48 of movable jaw 40
52 pair of longitudinal edges of movable jaw 40
54 pair of tabs of movable jaw 40
56 pair of aligned throughbores extending, respectively, transversely through pair of tabs 54 of movable jaw 40
58 first surface of movable jaw 40
60 second surface of movable jaw 40 for contacting fingers 22 of one hand 12
62 pin
64 compression spring
66 pair of ends of compression spring 64
68 space
70 other end of bracelet 14
72 other hand

DETAILED DESCRIPTION OF THE PREFERRED EMBODIMENT

Referring now to the figures, in which like numerals indicate like parts, and particularly to FIG. 1, which is a diagrammatic perspective view of the present invention in use, the clamp for holding in one hand and assisting in donning a bracelet of the present invention is shown generally at 10 for holding in one hand 12 and assisting in donning a bracelet 14.

Figure 2:
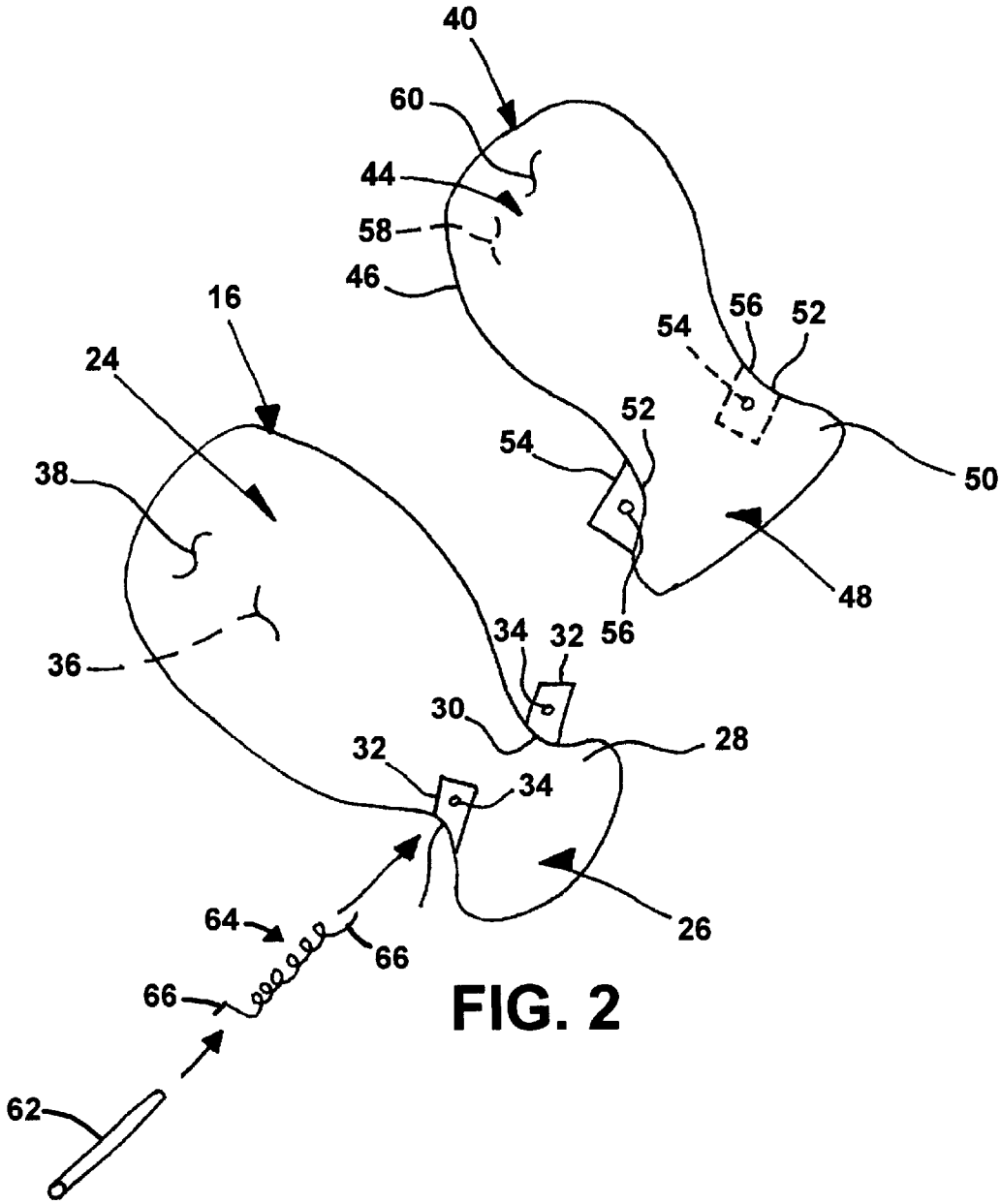
FIG. 2 is an enlarged exploded perspective view of the area generally enclosed by the dotted ellipse identified by ARROW 2 in FIG. 1 of the present invention.

The configuration of the clamp for holding in one hand and assisting in donning a bracelet 10 can best be seen in FIG. 2, which are, respectively, an enlarged exploded perspective view of the area generally enclosed by the dotted ellipse identified by ARROW 2 in FIG. 1 of the present invention, and a system diagram of the present invention, and as such, will be discussed with reference thereto.

The clamp for holding in one hand and assisting in donning a bracelet 10 comprises a stationary jaw 16 for extending along the palm 18 of the one hand 12 on which the bracelet 14 is to be donned and the wrist 20 on which the bracelet 14 is to be donned and for being releasably grasped between the palm 18 of the one hand 12 on which the bracelet 14 is to be donned and the fingers 22 of the one hand 12 on which the bracelet 14 is to be donned.

The stationary jaw 16 is substantially flat and coplanar and shaped generally like a bulbous hourglass with one end larger than the end, and both ends having rounded edges.

The stationary jaw 16 has a proximal end 24 for being releasably grasped between the palm 18 of the one hand 12 on which the bracelet 14 is to be donned and the fingers 22 of the one hand 12 on which the bracelet 14 is to be donned.

The proximal end 24 of the stationary jaw 16 is bulbously coplanarly flaring for wider releasable grasping between the palm 18 of the one hand 12 on which the bracelet 14 is to be donned and the fingers 22 of the one hand 12 on which the bracelet 14 is to be donned.

The stationary jaw 16 further has a distal end 26 for resting on the wrist 20 of the one hand 12 on which the bracelet 14 is to be donned.

The distal end 26 of the stationary jaw 16 narrows from the proximal end 24 of the stationary jaw 16 and terminates in a coplanar flare 28, and has a pair of longitudinal edges 30.

The stationary jaw 16 further has a pair of tabs 32 that extend perpendicularly upwardly, respectively, from the pair of longitudinal edges 30 of the distal end 26 of the stationary jaw 16.

The pair of tabs 32 of the stationary jaw 16 have a pair of aligned throughbores 34 that extend, respectively, transversely therethrough.

The stationary jaw 16 further has a first surface 36 for facing the palm of the one hand 12 on which the bracelet 14 is to be donned, and a second surface 38 that is disposed opposite to the first surface 36 of the stationary jaw 16 for contacting the fingers 22 of the one hand 12 on which the bracelet 14 is to be donned.

The clamp for holding in one hand and assisting in donning a bracelet 10 further comprises a movable jaw 40 pivotally mounted to, and biased against, the stationary jaw 16 for releasably holding one end 42 of the bracelet 14 therebetween.

The movable jaw 40 is substantially flat, coplanar, and resembles the distal end 26 of the stationary jaw 16.

The movable jaw 40 has a proximal end 44 that originates with a coplanar flare 46 that is normally vertically spaced from the second surface 38 of the stationary jaw 16, intermediate the proximal end 24 of the stationary jaw 16 and the distal end 26 of the stationary jaw 16.

The movable jaw 40 further has a distal end 48 that terminates in a coplanar flare 50 that normally contacts, and is normally biased against, the coplanar flare 28 on the distal end 26 of the stationary jaw 16, and a pair of longitudinal edges 52.

The movable jaw 40 further has a pair of tabs 54 that depend perpendicularly, respectively, from the pair of longitudinal edges 52 of the movable jaw 40, and adjoin, respectively, the pair of tabs 32 of the stationary jaw 16.

The pair of tabs 54 of the movable jaw 40 have a pair of aligned throughbores 56 that extend, respectively, transversely therethrough and align, respectively, with the pair of throughbores 34 in the pair of tabs 32 of the stationary jaw 16.

The movable jaw 40 further has a first surface 58 that faces the second surface 38 of the stationary jaw 16, and a second surface 60 that is disposed opposite to the first surface 58 of the movable jaw 40.

The clamp for holding in one hand and assisting in donning a bracelet 10 further comprises a pin 62 that pivotally mount the stationary jaw 16 to the movable jaw 40.

The pin 62 extends rotatably through the pair of throughbores 34 in the pair of tabs 32 of the stationary jaw 16 and through the pair of throughbores 56 in the pair of tabs 54 of the movable jaw 40.

The clamp for holding in one hand and assisting in donning a bracelet 10 further comprises a compression spring 64 that is disposed on the pin 62 and biases the movable jaw 40 against the stationary jaw 16.

The compression spring 64 has a pair of ends 66 that, respectively, contact the second surface 38 of the stationary jaw 16 and the first surface 58 of the movable jaw 40.

STEP 1: Press the proximal end 44 of the movable jaw 40 down towards the second surface 38 of the stationary jaw 16.

STEP 2: Cause the distal end 48 of the movable jaw 40 to separate from the distal end 26 of the stationary jaw 16 and form a space 68 therebetween.

STEP 3: Insert the one end 42 of the bracelet 14 in the space 68, with the bracelet 14 extending transversely therefrom.

STEP 4: Release the proximal end 44 of the movable jaw 40 from the second surface 38 of the stationary jaw 14.

STEP 5: Cause the one end 42 of the bracelet 14 to be releasably trapped between the distal end 26 of the stationary jaw 16 and the distal end 48 of the movable jaw 40.

STEP 6: Face the palm 18 of the one hand 12 up.

STEP 7: Position the first surface 36 of the stationary jaw against the palm 18 of the one hand 12, with the distal end 26 of the stationary jaw 16 resting on the wrist 20 of the one hand 12.

STEP 8: Grasp the proximal end 24 of the stationary jaw 16 between the palm 18 of the one hand 12 and the fingers 22 of the one hand 12.

STEP 9: Grasp the other end 70 of the bracelet 14 with the other hand 72.

STEP 10: Wrap the bracelet 14 around the wrist 20 of the one hand 12.

STEP 11: Secure the other end 70 of the bracelet 14 to the one end 42 of the bracelet 14.

STEP 12: Press again the proximal end 44 of the movable jaw 40 down towards the second surface 38 of the stationary jaw 16.

STEP 13: Release the bracelet 14 from the space 68.

It will be understood that each of the elements described above, or two or more together, may also find a useful application in other types of constructions differing from the types described above.

While the invention has been illustrated and described as embodied in a clamp for holding in a hand and assisting in donning a bracelet, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A clamp for holding in one hand and assisting in donning a bracelet, comprising:

a) a stationary jaw shaped generally like a bulbous hourglass with one end larger than the other end, and both ends having rounded edges for extending along the palm of the one hand on which the bracelet is to be donned and the wrist on which the bracelet is to be donned and for being releasably grasped between the palm of the one hand on which the bracelet is to be donned and the fingers of the one hand on which the bracelet is to be donned; and b) a nearly identically shaped movable jaw pivotally mounted to, and biased against, said stationary jaw, and together with said stationary jaw being for releasably holding one end of the bracelet therebetween c) a pin pivotally mounting said stationary jaw to said movable jaw; and d) a compression spring disposed on said pin and biasing said movable jaw against said stationary jaw; said clamp having no exterior sharp edges and being sized for fitting in the palm of a hand.

2. The clamp as defined in claim 1, wherein said stationary jaw is substantially flat and coplanar.

3. The clamp as defined in claim 1, wherein said stationary jaw has a proximal end for being releasably grasped between the palm of the one hand on which the bracelet is to be donned and the fingers of the one hand on which the bracelet is to be donned.

4. The clamp as defined in claim 3, wherein said proximal end of said stationary jaw is bulbously coplanarly flaring for wider releasable grasping between the palm of the one hand on which the bracelet is to be donned and the fingers of the one hand on which the bracelet is to be donned.

5. The clamp as defined in claim 3, wherein said stationary jaw has a distal end for resting on the wrist of the one hand on which the bracelet is to be donned.

6. The clamp as defined in claim 5, wherein said distal end of said stationary jaw narrows from said proximal end of said stationary jaw and terminates in a coplanar flare, and has a pair of longitudinal edges.

7. The clamp as defined in claim 6, wherein said stationary jaw further has a pair of tabs that extend perpendicularly upwardly, respectively, from said pair of longitudinal edges of said distal end of said stationary jaw.

8. The clamp as defined in claim 7, wherein said pair of tabs of said stationary jaw have a pair of aligned throughbores that extend, respectively, transversely therethrough.

9. The clamp as defined in claim 5, wherein said stationary jaw has:

a) a first surface for facing the palm of the one hand on which the bracelet is to be donned; and b) a second surface that is disposed opposite to said first surface of said stationary jaw for contacting the fingers of the one hand on which the bracelet is to be donned.

10. The clamp as defined in claim 5, wherein said movable jaw is substantially flat, coplanar, and resembles said distal end of said stationary jaw.

11. The clamp as defined in claim 9, wherein said movable jaw has a proximal end that originates with a coplanar flare that is normally vertically spaced from said second surface of said stationary jaw, intermediate said proximal end of said stationary jaw and said distal end of said stationary jaw.

12. The clamp as defined in claim 6, wherein said movable jaw has:

a) a distal end that terminates in a coplanar flare that normally contacts, and is normally biased against, said coplanar flare on said distal end of said stationary jaw; and b) a pair of longitudinal edges.

13. The clamp as defined in claim 12, wherein said movable jaw further have a pair of tabs that depend perpendicularly, respectively, from said pair of longitudinal edges of said movable jaw, and adjoin, respectively, said pair of tabs of said stationary jaw.

14. The clamp as defined in claim 13, wherein said pair of tabs of said movable jaw have a pair of aligned throughbores that extend, respectively, transversely therethrough and align, respectively, with said pair of throughbores in said pair of tabs of said stationary jaw.

15. The clamp as defined in claim 9, wherein said movable jaw has:

a) a first surface that faces said second surface of said stationary jaw; and b) a second surface that is disposed opposite to said first surface of said movable jaw.

16. The clamp as defined in claim 14, wherein said pin extends rotatably through said pair of throughbores in said pair of tabs of said stationary jaw and through said pair of throughbores in said pair of tabs of said movable jaw.

17. The clamp as defined in claim 15, wherein said compression spring has a pair of ends that, respectively, contact said second surface of said stationary jaw and said first surface of said movable jaw.

* * * * *